US007766716B2

(12) United States Patent
Fong et al.

(10) Patent No.: US 7,766,716 B2
(45) Date of Patent: Aug. 3, 2010

(54) DOLL THAT CAN BE ASSEMBLED IN VARIOUS WAYS

(76) Inventors: YunSang Fong, Sechuan Industrial Area, Baisha, Humen, Wing Hang Metal Plastic Factory, Dongguan (CN) 523912; SingLeong Chan, Sechuan Industrial Area, Baisha, Humen, Wing Hang Metal Plastic Factory, Dongguan (CN) 523912

( * ) Notice: Subject to any disclaimer, the term of this patent is extended or adjusted under 35 U.S.C. 154(b) by 354 days.

(21) Appl. No.: 11/686,419

(22) Filed: Mar. 15, 2007

(65) Prior Publication Data

US 2007/0281577 A1 Dec. 6, 2007

(30) Foreign Application Priority Data

Jun. 6, 2006 (CN) ..... 2006 2 0059909 U

(51) Int. Cl.
*A63H 3/16* (2006.01)

(52) U.S. Cl. ..... 446/99; D21/595; D21/621

(58) Field of Classification Search ..... 446/99, 446/321, 101, 97; D21/594, 621, 658
See application file for complete search history.

(56) References Cited

U.S. PATENT DOCUMENTS 171,533 A * 12/1875 Schmetzer ..... 446/101
1,481,129 A * 1/1924 French ..... 446/99
3,469,339 A * 9/1969 Thomas ..... 446/122
4,205,482 A * 6/1980 Christiansen et al. ..... 446/97
4,226,045 A * 10/1980 Lehmann et al. ..... 446/101
D283,150 S * 3/1986 Jensen ..... D21/635
4,789,369 A * 12/1988 Lyman ..... 446/101
2003/0190855 A1 * 10/2003 Teel ..... 446/101

* cited by examiner

*Primary Examiner*—Gene Kim
*Assistant Examiner*—Matthew B Stanczak
(74) *Attorney, Agent, or Firm*—Banger Shia

(57) ABSTRACT

The invention relates to the technical field of toys, and more specifically, to a doll capable of being assembled in multiple directions, comprising: a head member, a middle body member, and a foot member, wherein projection members or recessed areas are set on all sides of the head member, except the bottom side, which serves to connect with the middle body member of the doll, with said projection members or recessed areas at the top, left, and right sides of the head member being in the shape of a column or cavity. Through the engagement of the columns with the groove cavities and the engagement of the recessed areas with the projection members at the front and back sides of the head member, the doll is capable of being assembled with other dolls in multiple directions. Therefore, the doll of the invention can provide more fun and entertainment value, providing more opportunities for children to exercise their imaginations. Optionally, a set of key rings can be installed on the head member of the doll of the invention.

8 Claims, 2 Drawing Sheets

DOLL THAT CAN BE ASSEMBLED IN VARIOUS WAYS

CROSS-REFERENCE TO RELATED APPLICATIONS

Pursuant to 35 U.S.C §119 and the Paris Convention Treaty, this application claims the benefit of Chinese Patent Application No. CN 200620059909.5 filed Jun. 6, 2006, the contents of which are incorporated herein by reference.

BACKGROUND OF THE INVENTION

1. Field of the Invention

This invention relates to the technical field of toys, and more specifically, to a doll capable of being assembled with other dolls in various ways.

2. Description of the Related Art

Current dolls are discrete units. They are monotonous and lack a high level of entertainment value. If multiple dolls could be assembled together, this would have the beneficial effect of diversifying the shape of the doll, and thereby, would generate more fun, greater variety, and increase the entertainment value.

SUMMARY OF THE INVENTION

Therefore, it is one objective of the invention to provide a simply structured doll capable of being assembled with other dolls in multiple directions.

To achieve the above objective, a doll in accordance with the invention comprises a head member, a middle body member, and a foot member, wherein at least one projection member or a recessed area is formed on the four sides and the top side of said head member, and a groove is formed at the bottom side of said foot member of said doll.

In certain embodiments of the invention, a recessed area and at least one projection member are projected on the front side and the back side of the head member of the doll respectively, wherein the projection members can be engaged with the recessed area formed on the head member of other dolls corresponding to the shape of the projection members.

In certain embodiments of the invention, projection columns are projected on the left and right sides of the head member of the doll.

In certain embodiments of the invention, cavities can be formed on the left and right sides of the head member of the doll.

In certain embodiments of the invention, a pair of projection columns is projected on the top side of the head member of the doll.

In certain embodiments of the invention, a pair of projection spheres can be projected on the top of the head member of the doll.

In certain embodiments of the invention, a groove that serves to engage with the columns on the top side of the head member of other dolls is opened on the bottom side of the foot member of the doll.

In certain embodiments of the invention, at least one projection member or a recessed area is formed on all sides of the head member, except the bottom side, which serves to connect with the middle body member of the doll, wherein the projection members or recessed area on the top, left, and right sides of the head member are in the shape of a column or cavity, while those on the front and back sides can be in various shapes so as to increase the entertainment value.

In certain embodiments of the invention, the projection members on the top side of the head member are projection columns or spheres, while the recessed area at the bottom side of the foot member is a groove, wherein the columns or spheres are engaged with the groove so that two dolls are capable of being assembled together; the projection members on the left and right sides of the head member are projection columns, while the recessed area is a cavity, wherein the projection columns are engaged with the cavity so that two dolls are capable of being assembled together.

In certain embodiments of the invention, the recessed area and the projection members on the front side and the back side respectively are without shape limitations and may take the form of a polygon, ellipse, or irregular shape for the purpose of providing more entertainment value.

In certain embodiments of the invention, the front side of the head member of the doll can be formed with projection members, while the back side of the head member can be formed with a recessed area.

In certain embodiments of the invention, a set of key rings can be installed on the head member of the doll of the invention for the purpose of decoration.

Through the engagement of the projection members with the recessed areas and the engagement of columns or spheres with the cavities, the doll can be assembled with other dolls in multiple directions. Therefore, the doll of the invention can provide more fun and entertainment value, providing more opportunities for children to exercise their imaginations.

DETAILED DESCRIPTION OF THE EMBODIMENTS

A doll capable of being assembled with other dolls in multiple directions in accordance with the invention comprises a head member 20, a middle body member 30, and a foot member 10.

Figure 1:
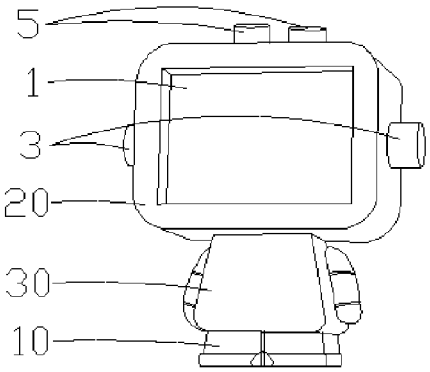
FIG. 1 is a structural projection view of a doll in accordance with a first embodiment of the invention.
Figure 2:
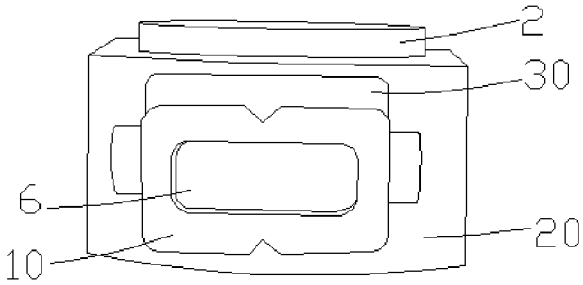
FIG. 2 is a bottom projection view of the doll of FIG. 1.

FIGS. 1 and 2 illustrate a doll in accordance with a first embodiment of the invention, wherein a pair of projection columns 5 are projected on the top side of the head member 20, columns 3 are projected on the left and right sides of the head member 20, a quadrangular recessed area 1 is formed at the front side of the head member 20, an elliptical projection member 2 is projected on the back side of the head member 20, while a groove 6 is opened at the bottom side of the foot member 10.

Figure 3:
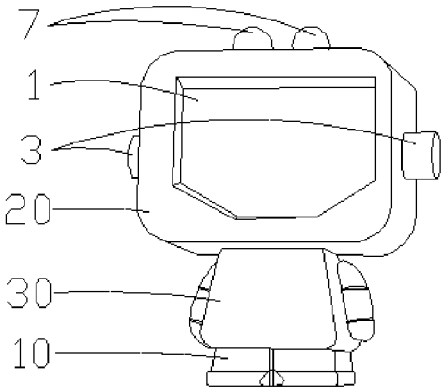
FIG. 3 is a structural projection view of a doll in accordance with a second embodiment of the invention.

FIGS. 2 and 3 illustrate a doll in accordance with a second embodiment of the invention, wherein a pair of spheres 7 are projected on the top side of the head member 20, columns 3 are projected on the left and right sides of the head member 20, a hexagonal recessed area 1 is formed at the front side of the head member 20, an elliptical projection member is projected on the back side of the head member 20, while a groove 6 is opened at the bottom side of the foot member 10.

Figure 4:
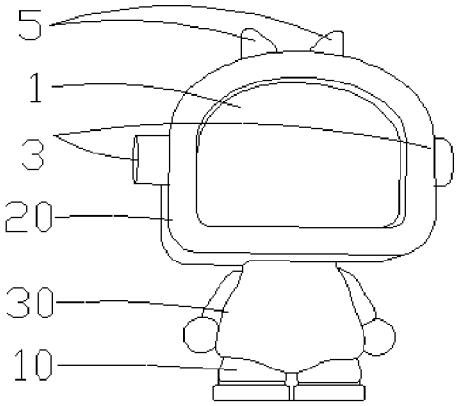
FIG. 4 is a structural projection view of a doll in accordance with a third embodiment of the invention.

FIG. 4 illustrates a doll in accordance with a third embodiment of the invention, wherein a pair of cone shaped columns 5 is projected on the top side of the head member 20, columns 3 are projected on the left and right sides of the head member 20, an irregularly shaped, rounded, recessed area 1 is formed at the front side of the head member 20, an irregular shaped projection member is also formed on the back side of the head member 20, while a groove 6 is opened at the bottom side of the foot member 10.

Figure 5:
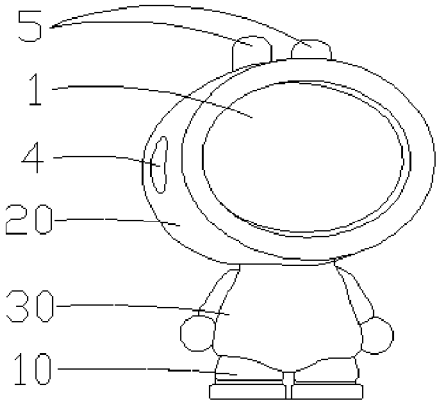
FIG. 5 is a structural projection view of a doll in accordance with a fourth embodiment of the invention.
Figure 6:
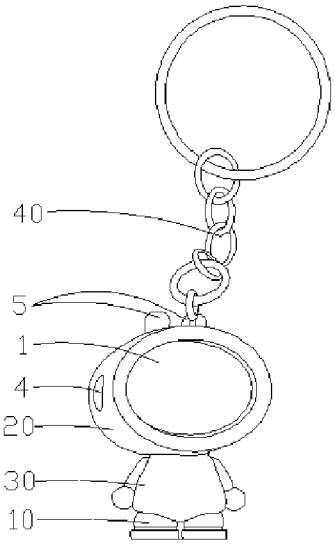
FIG. 6 is a structural projection view of a doll equipped with a set of key rings in accordance with a fourth embodiment of the invention.

FIGS. 5 and 6 illustrate a doll in accordance with a fourth embodiment of the invention, wherein a pair of columns 5 are projected on the top side of the head member 20, cavities 4 are formed on the left and right sides of the head member 20, an elliptical recessed area 1 is formed at the front side of the head member 20, an elliptical projection member is projected on the back side of the head member 20, while a groove 6 is opened at the bottom side of the foot member 10. As shown in FIG. 6, a set of key rings 40 is installed on the top side of the head member 20.

Figure 7:
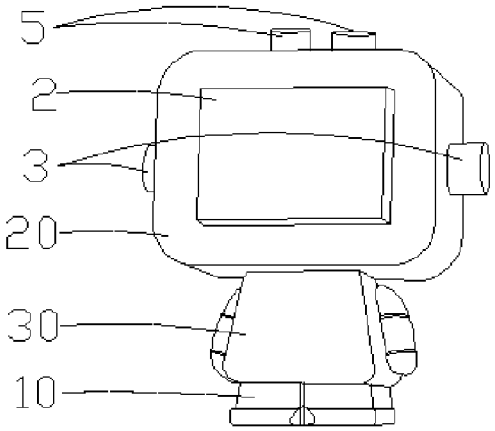
FIG. 7 is a structural projection view of a doll in accordance with a fifth embodiment of the invention.

FIG. 7 illustrates a doll in accordance with a fifth embodiment of the invention, wherein a pair of columns 5 are projected on the top side of the head member 20, columns 3 are projected on the left and right sides of the head member 20, a quadrangular projection member 2 is projected on the front side of the head member 20, an elliptical recessed area is formed at the back side of the head member 20, while a groove 6 is opened at the bottom side of the foot member 10.

Figure 8:
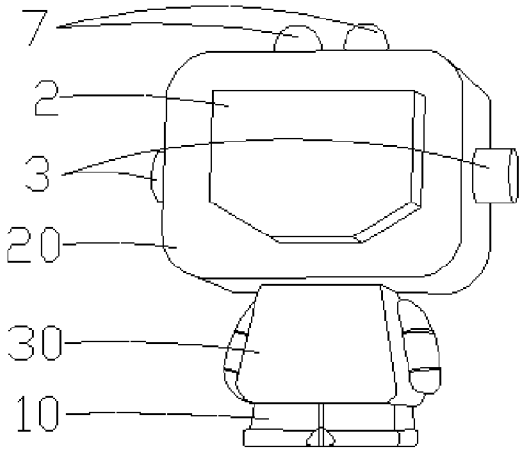
FIG. 8 is a structural projection view of a doll in accordance with a sixth embodiment of the invention.

FIG. 8 illustrates a doll in accordance with a sixth embodiment of the invention, wherein a pair of spheres 7 is projected on the top side of the head member 20, columns 3 are projected on the left and right sides of the head member 20, a hexagonal projection member 2 is projected on the front side of the head member 20, an elliptical recessed area is formed at the back side of the head member 20, while a groove 6 is opened at the bottom side of the foot member 10.

Figure 9:
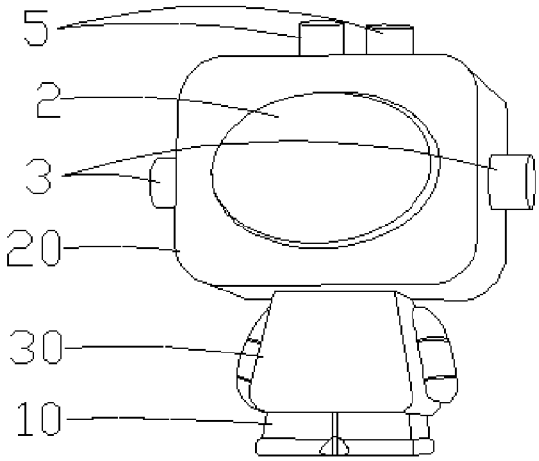
FIG. 9 is a structural projection view of a doll in accordance with a seventh embodiment of the invention.

FIG. 9 illustrates a doll in accordance with a seventh embodiment of the invention, wherein a pair of columns 5 is projected on the top side of the head member 20, columns 3 are projected on the left and right sides of the head member 20, en elliptical projection member 2 is projected on the front side of the head member 20, a quadrangular recessed area is formed at the back side of the head member 20, while a groove 6 is opened at the bottom side of the foot member 10.

The foregoing descriptions are considered as illustrative embodiments of the invention. Since numerous modifications and changes will readily occur to those skilled in the art, it is not desired to limit the invention to the exact construction and operation shown and described, and accordingly, all the suitable modifications and equivalents that may be resorted to fall within the scope of the invention.

What is claimed is:

1. A doll, comprising:

a head member (20) having a top side, a front side, a back side, a left side, a right side, and a bottom side;

a middle body member (30); and a foot member (10) having a bottom side; wherein a pair of columns (5) being projected on the top side of the head member (20), a column (3) projected on both the left and right sides of the head member (20), a quadrangular recess formed at the front side of the head member (20), an elliptical projection (2) formed on the back side of the head member (20), and a groove (6) opened at the bottom side of the foot member (10).

2. A doll, comprising:

a head member (20) having a top side, a front side, a back side, a left side, a right side, and a bottom side;

a middle body member (30); and a foot member (10) having a bottom side; wherein a pair of cone shaped columns (5) being projected on the top side of the head member (20), a column (3) projected on both the left and right sides of the head member (20), an irregularly shaped, rounded, recess formed at the front side of the head member (20), an irregularly shaped projection formed on the back side of the head member (20), and a groove (6) opened at the bottom side of the foot member (10).

3. A doll, comprising:

a head member (20) having a top side, a front side, a back side, a left side, a right side, and a bottom side;

a middle body member (30); and a foot member (10) having a bottom side; wherein a pair of columns (5) being projected on the top side of the head member (20), a cavity (4) formed on both the left and right sides of the head member (20), an elliptical recess formed at the front side of the head member (20), an elliptical projection formed on the back side of the head member (20), and a groove (6) opened at the bottom side of the foot member (10).

4. The doll of claim 3, wherein a set of key rings (40) is installed on the top side of the head member (20).

5. A doll, comprising:

a head member (20) having a top side, a front side, a back side, a left side, a right side, and a bottom side;

a middle body member (30); and a foot member (10) having a bottom side; wherein a pair of columns (5) being projected on the top side of the head member (20), a column (3) projected on both the left and right sides of the head member (20), a quadrangular projection formed at the front side of the head member (20), an elliptical recess formed on the back side of the head member (20), and a groove (6) opened at the bottom side of the foot member (10).

6. A doll, comprising:

a head member (20) having a top side, a front side, a back side, a left side, a right side, and a bottom side;

a middle body member (30); and a foot member (10) having a bottom side; wherein a pair of columns (5) being projected on the top side of the head member (20), a column (3) projected on both the left and right sides of the head member (20), an elliptical projection formed at the front side of the head member (20), a quadrangular recess formed on the back side of the head member (20), and a groove (6) opened at the bottom side of the foot member (10).

7. A doll, comprising: a head member (20) having a top side, a front side, a back side, a left side, a right side, and a bottom side; a middle body member (30); and a foot member (10) having a bottom side; wherein a pair of sphere shaped columns (7) being projected on the top side of the head member (20), a column (3) projected on the left and right sides of the head member (20), a hexagonal recess formed at the front side of the head member (20), an elliptical projection formed on the back side of the head member (20), while a groove (6) is opened at the bottom side of the foot member (10).

8. A doll, comprising: a head member (20) having a top side, a front side, a back side, a left side, a right side, and a bottom side; a middle body member (30); and a foot member (10) having a bottom side; wherein a pair of sphere shaped columns (7) being projected on the top side of the head member (20), a column (3) projected on the left and right sides of the head member (20), a hexagonal projection formed at the front side of the head member (20), an elliptical recess formed on the back side of the head member (20), while a groove (6) is opened at the bottom side of the foot member (10).

* * * * *